US008615909B2

(12) United States Patent
Pang et al.

(10) Patent No.: US 8,615,909 B2
(45) Date of Patent: Dec. 31, 2013

(54) STEAM DISCHARGE UNIT FOR USE IN A SOLEPLATE OF A STEAM IRON

(75) Inventors: Yen Leng Pang, Singapore (SG); Ajit Pal Singh, Drachten (NL); Boon Tek Tn, Johor Bahru (MY); Roel Alexander Rethmeier, Drachten (NL); Asok Kumar Kasevan, Johor Baru (MY)

(73) Assignee: Koninklijke Philips N.V., Eindhoven (NL)

( * ) Notice: Subject to any disclaimer, the term of this patent is extended or adjusted under 35 U.S.C. 154(b) by 112 days.

(21) Appl. No.: 13/264,409

(22) PCT Filed: Apr. 30, 2010

(86) PCT No.: PCT/IB2010/051893
§ 371 (c)(1),
(2), (4) Date: Oct. 14, 2011

(87) PCT Pub. No.: WO2010/131148
PCT Pub. Date: Nov. 18, 2010

(65) Prior Publication Data

US 2012/0042547 A1 Feb. 23, 2012

(30) Foreign Application Priority Data

May 14, 2009 (EP) ..... 09160197

(51) Int. Cl.
*D06F 75/24* (2006.01)
*D06F 75/18* (2006.01)

(52) U.S. Cl.
USPC ..... 38/77.6; 38/77.83

(58) Field of Classification Search
USPC ..... 38/74, 77.83, 80, 81, 88, 93, 97; 219/245
See application file for complete search history.

(56) References Cited

U.S. PATENT DOCUMENTS

| | | | | |
|---|---|---|---|---|
| 1,597,427 | A * | 8/1926 | Brenizer | 38/77.6 |
| 1,674,092 | A * | 6/1928 | Brewer | 38/77.6 |
| 1,749,639 | A * | 3/1930 | Leprestre | 38/77.6 |
| 2,271,289 | A * | 1/1942 | Dowinsky | 38/77.6 |
| 3,299,549 | A * | 1/1967 | Blank | 38/77.6 |
| 4,077,143 | A * | 3/1978 | Walker et al. | 38/77.83 |
| 6,117,214 | A | 9/2000 | Peter et al. | |
| 6,953,527 | B2 | 10/2005 | Brower et al. | |
| 2006/0210784 | A1 * | 9/2006 | Shi et al. | 428/304.4 |
| 2008/0115740 | A1 * | 5/2008 | You | 122/235.14 |

FOREIGN PATENT DOCUMENTS

| | | | |
|---|---|---|---|
| EP | 1750018 | A2 | 2/2007 |
| EP | 2022884 | A1 | 2/2009 |
| GB | 658299 | | 10/1951 |
| GB | 1069535 | | 5/1967 |
| HU | 39794 | A | 4/1985 |

* cited by examiner

*Primary Examiner* — Ismael Izaguirre

(57) ABSTRACT

A steam discharge unit (1) comprises a chamber (10) for accommodating a flow of a water-steam mixture and heating the water-steam mixture, an inlet (11) to the chamber (10), and an outlet (12) from the chamber (10). In order to avoid water droplets from exiting the chamber (10) through the outlet (12) along with a flow of steam, special measures are taken, which comprise a barrier (20) arranged inside the chamber (10), in a flow path of a water-steam mixture from the inlet (11) to the outlet (12), and a hydrophobic surface (30) arranged preferably close to the outlet (12). In case water droplets remain inside the chamber (10) and tend to move towards the outlet (12), an actual release of the water droplets from the chamber (10) cannot take place by virtue of the presence of the barrier (20) and the hydrophobic surface (30) as mentioned.

19 Claims, 6 Drawing Sheets

STEAM DISCHARGE UNIT FOR USE IN A SOLEPLATE OF A STEAM IRON

FIELD OF THE INVENTION

The present invention relates to a discharge unit for use in a steaming device, comprising:

- a chamber for accommodating a flow of a water-steam mixture and heating the water-steam mixture;
- an inlet for supplying a water-steam mixture to the chamber; and
- an outlet for letting out steam from the chamber.

Furthermore, the present invention relates to a soleplate for use in a steam iron, which is provided with at least one steam discharge unit.

BACKGROUND OF THE INVENTION

A steaming device comprising a unit for receiving so-called wet steam, i.e. a water-steam mixture, from a steam generator, and letting out dry steam is known. For example, HU 193751 discloses a steaming device having a steam discharge unit which is denoted as a condenser vessel, and which has a cylindrical inner cavity and an inlet for letting wet steam into the cavity. During operation of the steaming device, rotating motion is imparted to wet steam that is supplied to the cavity of the condenser vessel, so that water droplets are separated from the steam by centrifugal force. The water is discharged from the vessel or evaporated by heating, and the steam is discharged in line with the axis of the rotating motion, i.e. at a central position. In particular, the condenser vessel is in the form of a housing with a cylindrical cavity, a tangential steam inlet pipe and a concentric dry steam discharge pipe. HU 193751 furthermore discloses a manual steam iron which is provided with disc-shaped evaporator cavities in its base, wherein each of the cavities acts as the above-described condenser vessel.

A disadvantage of the condenser vessel known from HU 193751 is that spitting may occur. Spitting is a well-known problem in the field of steam irons, and involves an undesirable situation in which water droplets are carried along by the steam that is released from a soleplate, as a result of which items to be ironed may get wet, and may even get stained. The condenser vessel is designed to only let out dry steam, but in practice it occurs that water droplets escape from the vessel along with the flow of steam. There are various factors contributing to the problem. Among other things, as the condenser vessel is made to fit inside the soleplate of an iron, the condenser vessel has a shallow and compact design. As a consequence, the distance between the inlet and the outlet is relatively short, and the water-steam mixture does not remain in the vessel long enough for the water to evaporate and/or flow towards the discharge of the vessel.

In general, in a steaming device in which steam is separately generated and transferred via a hose or another suitable intermediate member to a discharge unit, which may be a soleplate of a steam iron, or a steamer head, for example, condensation may occur along a steam flow path, resulting in water entering the discharge unit along with the steam at relatively high velocities. Additionally, foaming can occur in the steam generator due to concentration of scale and impurities, resulting in water being carried over along with steam to the discharge unit. In an iron, it is possible for a user to choose a low temperature setting. However, with such a setting, a low energy content is obtained, resulting in a situation in which it is difficult/impossible to realize sufficiently fast evaporation of water entering the chamber of the discharge unit. Due to any of the above-mentioned factors, water leakage from the discharge unit can occur while steaming is activated.

SUMMARY OF THE INVENTION

It is an object of the present invention to provide a solution to the problem of spitting while maintaining the shallow and compact design of a steam discharge unit which is suitable to be used in a soleplate of a steam iron, for example. A solution is needed to ensure that water is retained effectively in the chamber of the discharge unit.

The object of the present invention is achieved by a steam discharge unit comprising a chamber, an inlet and an outlet associated with the chamber, a barrier which is arranged inside the chamber, in a flow path of a water-steam mixture from the inlet to the outlet, and a hydrophobic surface which is located inside the chamber as well.

On the basis of the presence of a barrier in the flow path of a water-steam mixture from the inlet of the chamber to the outlet, it is achieved that water cannot easily travel along walls of the chamber near to the steam inlet and then be ejected. The barrier is adapted to be in the way and block a direct route towards the outlet. In a preferred embodiment of the discharge unit according to the present invention, the barrier is arranged around the outlet. For example, the barrier may be shaped like a tube, and may extend inwardly from a wall of the chamber in which the outlet is located. In any case, the barrier constitutes an obstacle in the flow path of a water-steam mixture from the inlet of the chamber to the outlet, i.e. an object which forces the flow to follow another route than a direct route, as the flow cannot pass at the position where the barrier is located, but needs to get around it in order to be capable of moving on. Hence, at the position of the barrier, a change of a direction of the flow takes place, due to a blocking function of the barrier which does not allow for continuation of a flow in an initial direction. In a first instance, the flow collides with the barrier, and in a second instance, the flow follows the barrier until the flow is capable of passing the barrier.

Furthermore, on the basis of the presence of a hydrophobic surface, it is achieved that the formation of a continuous film of water which may easily flow out of the chamber along with the steam is avoided. Tests performed by the Applicant have shown that with the hydrophobic surface being present, water leakage indeed does not occur. Instead, it appears that water droplets merely join together to form bigger drops, and that the bigger drops fall down to a lower position inside the chamber rather than creating a sheet of water. When the outlet is positioned at a relatively high level, it is ensured that the water cannot pass through the outlet.

According to the present invention, a combination of a barrier and a hydrophobic surface is applied, as a result of which spitting is completely avoided. The hydrophobic surface can be realized by having a hydrophobic coating such as polytetrafluorethylene (PTFE) applied to a wall portion of the chamber, or by having a part made of high temperature resistant and hydrophobic material such as PTFE. The present invention covers both options, in view of the fact that both options offer the same functionality. Within the scope of the present invention, it is advantageous to have a hydrophobic effect at some position inside the chamber, and for that reason, a surface having hydrophobic properties is provided, wherein it is not relevant whether the surface is obtained by applying a coating having hydrophobic properties or by providing a part which is made of a material having hydrophobic properties, as both options yield the same hydrophobic effect as mentioned, namely at the exterior surface of the coating or the part as mentioned.

Alternative materials for the hydrophobic surface, for example other hydrophobic polymers, and finishes, for example finishes adapted to create a lotus leaf effect, can be used as well. In a situation in which the barrier is arranged around the outlet, the hydrophobic surface may be arranged such as to surround the barrier. In general, it is preferred for the hydrophobic surface to be located in the immediate surroundings of the outlet, in order to minimize the chance that any water droplet reaching those surroundings flows towards the outlet and exits the chamber.

Preferably, the chamber of the discharge unit according to the present invention is a so-called cyclonic steam chamber which comprises a curved wall. During operation of the steaming device, the wall is heated, and due to the curved shape, heat transfer to the water is enhanced as the water is spread against the wall and pushed against the wall by the principle of centrifugal force. The curved wall serves as the heated surface of the chamber, which can extract directly the energy from a heating element. In this way, energy availability for steaming against the curved wall is guaranteed.

A cyclonic steam chamber may be provided with an inlet having a tangential orientation with respect to the curved wall, in order to allow smooth entry of a flow of a water-steam mixture into the chamber. A tangentially oriented inlet maintains the high velocity of the flow, and maximizes the centrifugal effect as mentioned in the foregoing.

Advantageously, in the cyclonic steam chamber, the outlet is located at another wall of the chamber than the curved wall. This feature, combined with the tangentially oriented inlet, allows the water to make repeated loops inside the chamber, along the curved wall. Hence, the length available for steaming is enormous, in a compact design of the chamber, which is very advantageous in view of heat transfer.

Preferably, the outlet has a central position with respect to the curved wall of the chamber. The water enters the chamber at the curved wall and is confined to the curved wall due to centrifugal force. At a central position, the outlet is located as far as possible from the curved wall, so that the possibility of water reaching the outlet is minimized.

The curved wall of the cyclonic steam chamber may be provided with a taper in order to force the water to flow to another wall which is connected to the curved wall. In any case, the taper can be used to guide the water further away from the outlet.

Besides the hydrophobic surface, the discharge unit may comprise a hydrophilic surface for enhancing steam formation. It will be understood that such a hydrophilic surface is preferably positioned at a distance from the outlet.

In a practical embodiment of the discharge unit according to the present invention, the chamber is shaped like a cylinder having two end walls and a curved side wall extending between the end walls, wherein the barrier is shaped like a tube extending inwardly from one of the end walls of the cylinder. In this embodiment, the hydrophobic surface may be located at the tube-shaped barrier, and the tube-shaped barrier may be arranged such as to surround the outlet. Hence, in this embodiment, it is practically impossible for water droplets to reach the outlet and be discharged from the chamber with a steam flow. Due to the presence of the barrier, a path towards the outlet is blocked, and water droplets are forced to leave the outlet area as soon as they reach the hydrophobic surface, as they associate to form bigger water drops, which subsequently get detached from the surface.

The discharge unit may further comprise an additional barrier which is located inside the chamber for directing the flow of the water-steam mixture. In case the chamber is a cyclonic chamber, it is advantageous for the barrier to have a curved directing surface.

In order to even further reduce the risk of water droplets being ejected from the outlet, it is advantageous if a portion of an inner surface of the chamber surrounding the outlet is provided with a pattern of grooves and ribs. In other words, it is advantageous if the inner surface of the chamber is partly corrugated, namely at a position close to the outlet, such that the outlet is completely surrounded by a pattern of grooves and ribs. Unlike a flat surface, a surface comprising grooves and ribs is capable of catching and collecting circulating water droplets, and hinder transportation of the water droplets by high velocity steam towards the outlet.

The above-described and other aspects of the present invention will be apparent from and elucidated by means of the following detailed description of a number of embodiments of a discharge unit according to the present invention.

BRIEF DESCRIPTION OF THE DRAWINGS

The present invention will now be explained in greater detail with reference to the Figures, in which equal or similar parts are indicated by the same reference signs, and in which.

It is noted that in all of the Figures, directions of a flow of a water-steam mixture and/or water droplets and/or steam are diagrammatically indicated by means of arrows.

DETAILED DESCRIPTION OF EMBODIMENTS

Figure 1:
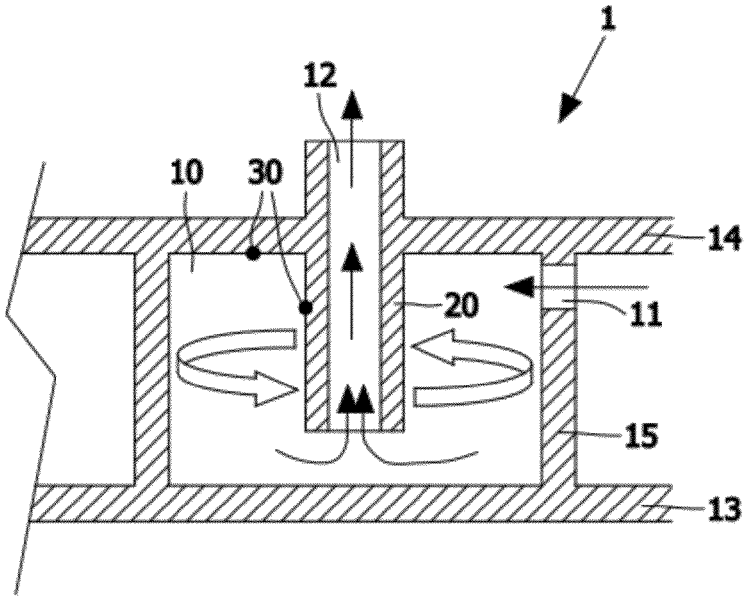
FIG. 1 diagrammatically shows a sectional view of a first embodiment of the discharge unit according to the present invention.
Figure 2:
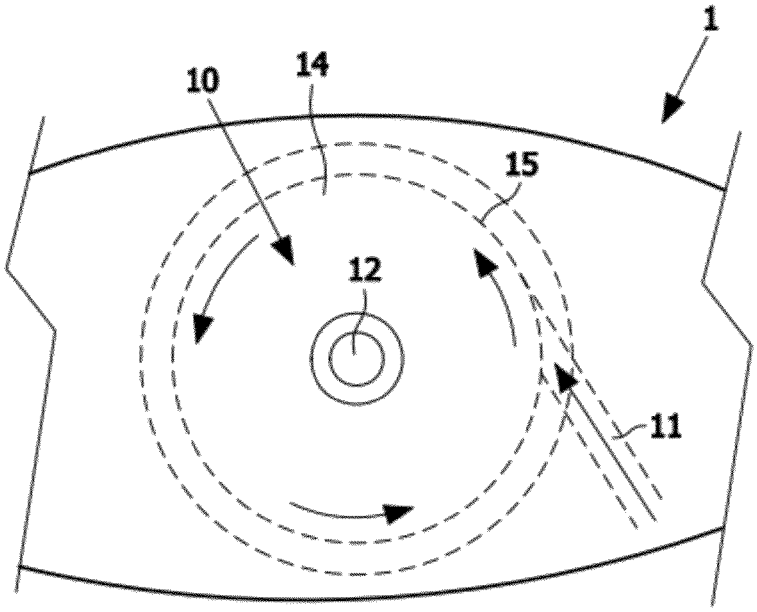
FIG. 2 diagrammatically shows a top view of the first embodiment of the discharge unit according to the present invention.
Figure 3:
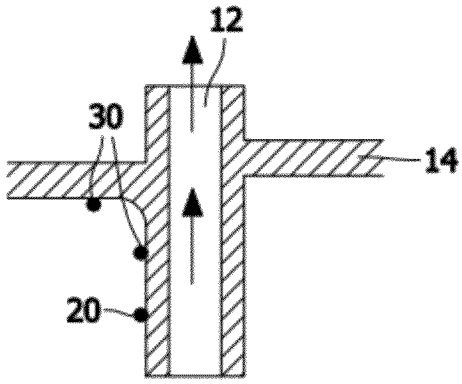
FIGS. 3-6 illustrate various options of a design of a barrier of the discharge unit, and a connection of the barrier to a wall of a chamber of the discharge unit, the left and right sections of each Figure showing examples of shapes.
Figure 4:
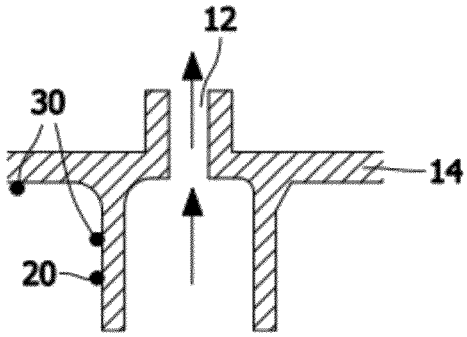
Figure 5:
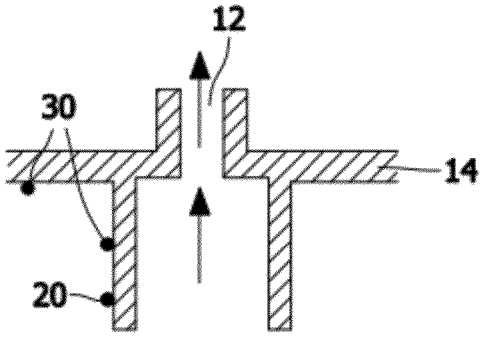
Figure 6:
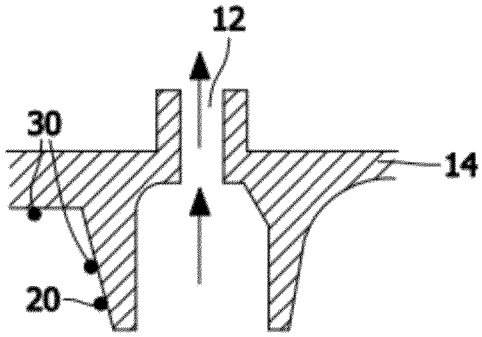

FIGS. 1 and 2 show views of a first embodiment of a discharge unit 1 according to the present invention. The discharge unit 1 comprises a chamber 10, an inlet 11 to the chamber 10, and an outlet 12 from the chamber 10. During operation, a water-steam mixture is supplied to the chamber 10 via the inlet 11, and only dry steam is discharged from the chamber 10 via the outlet 12. The chamber 10 is shaped like a cylinder having two end walls 13, 14 and a curved side wall 15 extending between the end walls 13, 14. In the shown example, the side wall 15 has a circular circumference. Furthermore, the inlet 11 is located in the side wall 15, and has a tangential orientation with respect to the side wall 15. In FIG. 2, the inlet 11 and the side wall 15 are indicated by means of dashed lines.

The basics of the functioning of the chamber 10 are explained in the following. A water-steam mixture that is introduced into the chamber 10 through the inlet 11 is made to follow a circular path, or, actually, a helical path, due to the curved shape of the side wall 15 of the chamber 10. In the process, a centrifugal effect occurs. The fact that the inlet 11 has a tangential orientation with respect to the side wall 15 contributes to a smooth entry of the water-steam mixture into the chamber 10. Furthermore, the centrifugal effect is maximized on the basis of this fact, and the velocity of the flow supplied to the chamber 10 is maintained as much as possible, so that the velocity of the flow inside the chamber 10 may be as high as possible. All aspects as described above contribute to an evaporation process of water droplets in the water-steam mixture, which takes place under the influence of heat supplied by one or more suitable heating elements (not shown) adapted to heat at least the side wall 15. Heat transfer from the heating element(s) to the water droplets is directly related to the duration of contact of the water droplets to the side wall 15, and it is therefore advantageous to create opportunities for intensive contact.

Advantageously, the position of the outlet 12 is as far as possible from the side wall 15. Such a position of the outlet 12 is a central or concentric position as shown in the Figures. By virtue of this position, a phenomenon called spitting, which is an unexpected release of water droplets from the discharge unit 1, is minimized. However, in order to completely avoid the spitting phenomenon, the discharge unit 1 has special features which are aimed at preventing water droplets from reaching the outlet 12. Under certain circumstances, factors like the curved shape of the side wall 15, the tangential orientation of the inlet 11 with respect to the side wall 15, and the central positioning of the outlet 12 may not be sufficient for avoiding spitting. In other words, under certain circumstances, it is not possible to evaporate all of the water droplets fast enough, and water droplets are carried along with steam flowing from the chamber 10 through the outlet 12. Such a situation is not at all desirable, and special measures are taken in order to avoid this situation under all circumstances.

In the first place, a barrier 20 is placed inside the chamber 10, at a position in which the barrier 20 is in the way of a flow of a water-steam mixture from the inlet 11 to the outlet 12. The barrier 20 may have any suitable shape and may be placed at any suitable position for performing this function. In the shown example, the barrier 20 is designed like a tube which is placed around the outlet 12, and which extends inwardly from the end wall 14 where the outlet 12 is present. The inlet 11 of the chamber 10 is positioned at another level than an inlet of the tube-shaped barrier 20, so that it is not possible for water droplets to reach the outlet 12 shortly after their introduction into the chamber 10. Instead, it is ensured that the water droplets are taken along in a circulating flow, so that there is enough time and a sufficient heat transfer for an evaporation process to take place.

In the second place, a hydrophobic surface 30 is located inside the chamber 10. Advantageously, the hydrophobic surface 30 is arranged in the immediate surroundings of the outlet 12, although the surface 30 could be located anywhere inside the chamber 10 within the scope of the present invention, or comprise various portions which are located at various positions. In the shown example, both the barrier 20 and the end wall 14 where the outlet 12 and the barrier 20 are located are provided with a hydrophobic layer. As an alternative, it is possible for the barrier 20 and the end wall 14 as mentioned to be made of a hydrophobic material. In any case, by virtue of the presence of a hydrophobic surface 30 in the immediate surroundings of the outlet 12, formation and attachment of a continuous water film near the outlet 12 is avoided. A hydrophobic surface causes water droplets to be joined such as to form bigger drops, and the drops of water fall down as they grow bigger, so that they are removed from an area that is relatively near to the outlet 12, and there is no danger of the water reaching the outlet 12.

At least a portion of an inner surface of the other end wall 13 remote from the end wall 14 where the outlet 12 and the barrier 20 are present can be optionally provided with a hydrophilic layer, which aids the steaming of the water droplets coming into contact with the surface.

As already noted, the barrier 20 may have any suitable shape. When the outlet 12 comprises a short tube as is the case in the shown example, and the barrier 20 is tube-shaped as well, the diameters of the tubes may be the same, but this is not necessary. For example, it is also possible for the barrier 20 to have a larger inner diameter than the outlet 12. Furthermore, the transition from the barrier 20 to the outlet 12 may be through a perpendicular edge as is the case in the shown example, but may also be through a round edge or a beveled edge, for example. Also, a surface of the barrier 20 may be tapered such as to enhance the flow of water away from the outlet 12. Examples of various options are illustrated in FIGS. 3-6, with each section of each Figure showing a different possible shape.

Figure 7:
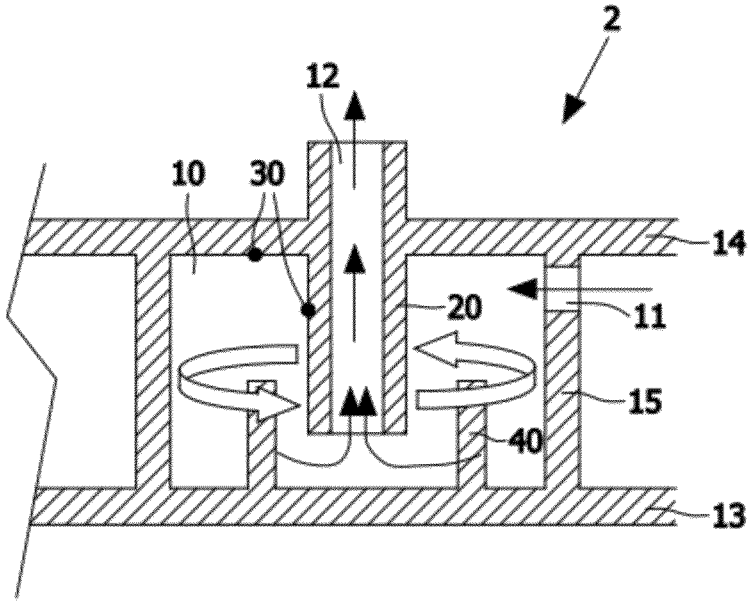
FIG. 7 diagrammatically shows a sectional view of a second embodiment of the discharge unit according to the present invention.
Figure 8:
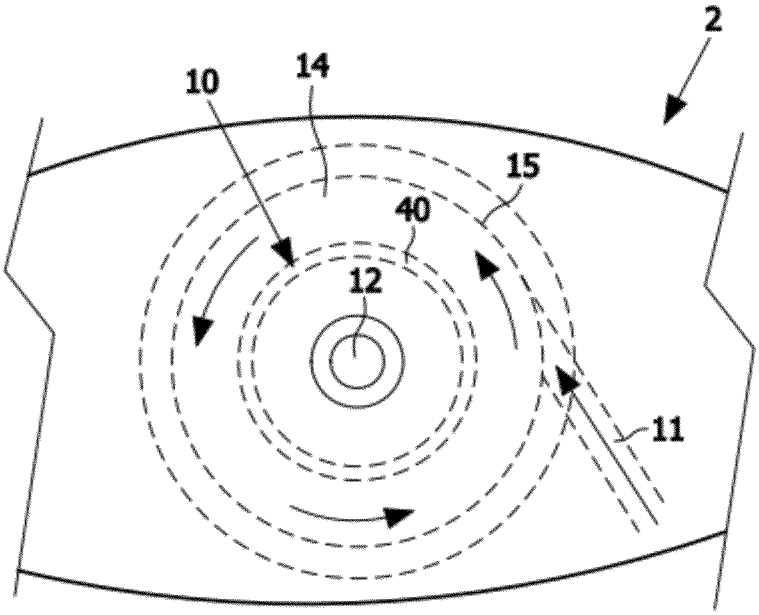
FIG. 8 diagrammatically shows a top view of the second embodiment of the discharge unit according to the present invention.

FIGS. 7 and 8 show views of a second embodiment of a discharge unit 2 according to the present invention. Like the discharge unit 1 according to the first embodiment, the discharge unit 2 according to the second embodiment comprises a chamber 10, an inlet 11, an outlet 12, a barrier 20, and a hydrophobic surface 30. Furthermore, the discharge unit 2 according to the second embodiment comprises an additional barrier 40 which is located at the other end wall 13 of the chamber 10 remote from the end wall 14 where the barrier 20 for blocking water droplets on their way to the outlet 12 is located. Preferably, the additional barrier 40 is tube-shaped and has a circular outer circumference, so that water-separation efficiency of the discharge unit 2 may be enhanced on the basis of an improved directing process performed on the flow of the water-steam mixture. The circular outer surface of the additional barrier 40 contributes to the centrifugal effect and helps the flow to circulate along the side wall 15.

Figure 9:
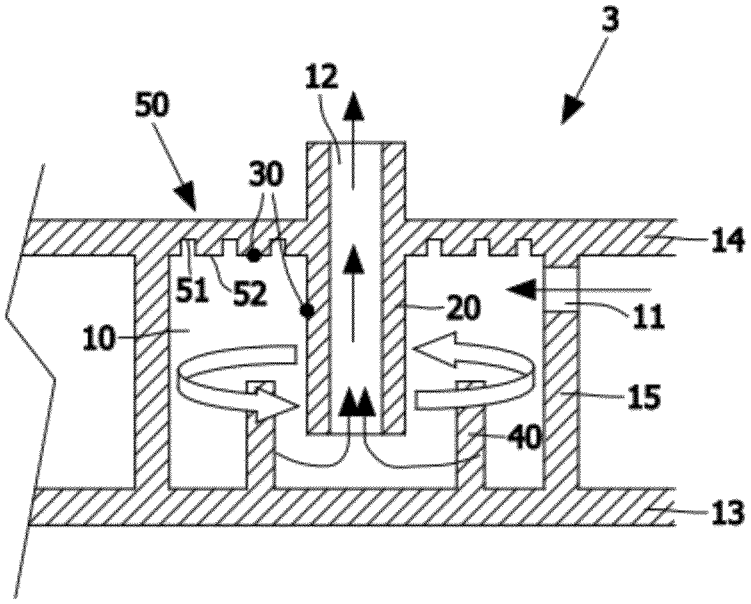
FIG. 9 diagrammatically shows a sectional view of a third embodiment of the discharge unit according to the present invention.
Figure 10:
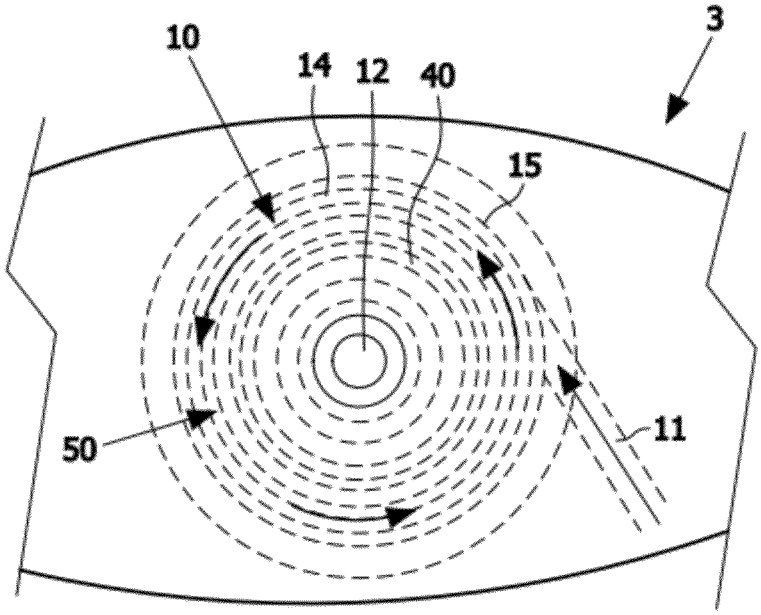
FIG. 10 diagrammatically shows a top view of the third embodiment of the discharge unit according to the present invention.

FIGS. 9 and 10 show views of a third embodiment of a discharge unit 3 according to the present invention. Like the discharge unit 2 according to the second embodiment, the discharge unit 3 according to the third embodiment comprises a chamber 10, an inlet 11, an outlet 12, a barrier 20, a hydrophobic surface 30, and an additional barrier 40. Furthermore, in the discharge unit 3 according to the third embodiment, an inner surface of the end wall 14 where the outlet 12 and the barrier 20 are located is provided with a pattern 50 of grooves 51 and ribs 52. In the shown example, the grooves 51 and ribs 52 are positioned in a concentric arrangement around the outlet 12. The grooves 51 and ribs 52 serve for collecting water droplets, and for reducing easy transportation of the water droplets by high velocity steam to the outlet 12. In this way, the pattern 50 of grooves 51 and ribs 52 enhances the water blocking function of the barrier 20.

The discharge unit 1, 2, 3 according to the present invention may be used in various applications. For example, the discharge unit 1, 2, 3 may be intended to be part of a soleplate of a steam iron, but is also suitable to be used in other devices having a steaming function.

Figure 11:
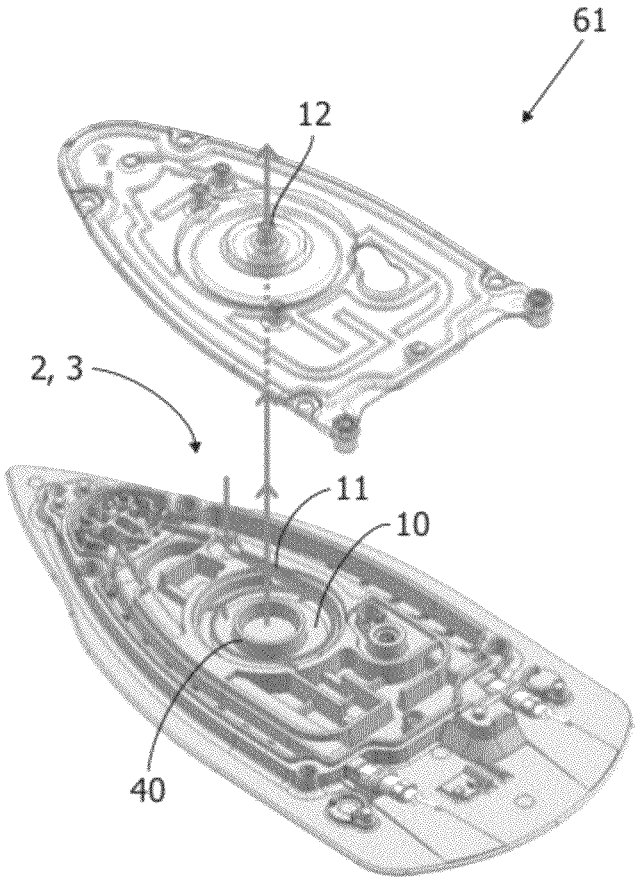
FIG. 11 diagrammatically shows a perspective view of two parts of a soleplate according to the present invention, which is suitable to be used in a steam iron.

FIG. 11 shows a view of two parts of a soleplate 61 according to the present invention, which is suitable to be used in a steam iron. The soleplate 61 is provided with a discharge unit 2, 3 according to the present invention, i.e. a discharge unit 2, 3 comprising a chamber 10 delimited by two end walls 13, 14 and a curved side wall 15, an inlet 11 to the chamber 10, an outlet 12 from the chamber 10, a barrier 20, and a hydrophobic surface 30. In the shown example, the discharge unit 2, 3 which is arranged inside the soleplate 61 also comprises an additional barrier 40.

Figure 12:
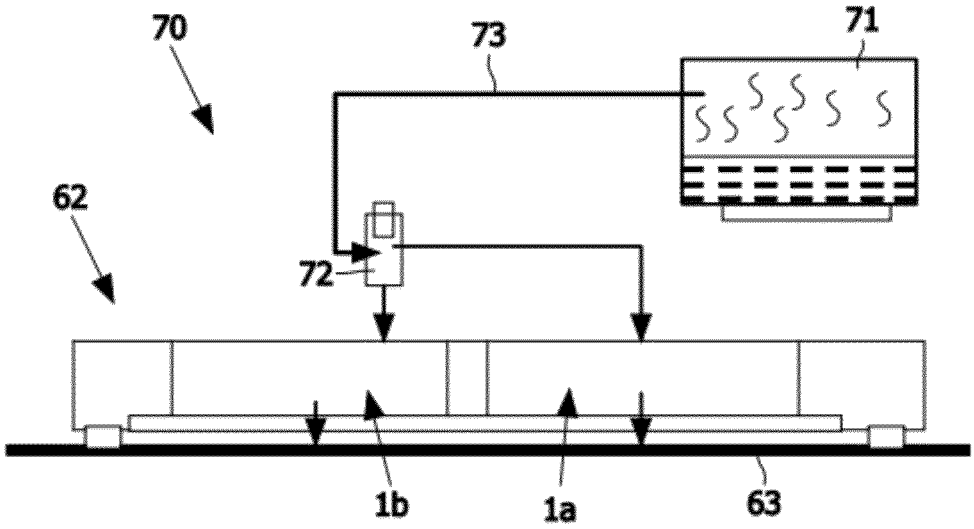
FIG. 12 diagrammatically shows a sectional view of a steaming device according to the present invention, comprising a steam generator, and a soleplate having two discharge units.

FIG. 12 shows a view of a steaming device 70 according to the present invention, which comprises a steam generator 71 for generating steam in any suitable known manner, and a soleplate 62 having an ironing plate 63 for contacting objects to be ironed, which is provided with a number of steam vents. Furthermore, the soleplate 62 has two discharge units 1*a*, 1*b* comprising a barrier 20 and a hydrophobic surface 30. One of the discharge units 1*a*, 1*b* is a main discharge unit 1*a* and serves for a more or less continuous supply of steam during an ironing process, and another of the discharge units 1*a*, 1*b* is an auxiliary discharge unit 1*b* and serves for a shot of steam during an ironing process, if sodesired by a user. In the steaming device 70, a deviator 72 is arranged for supplying a water-steam mixture from the steam generator 71 to either one of the discharge units 1*a*, 1*b*. Normally, the deviator 72 is in a state for supplying a water-steam mixture to the main discharge unit 1*a*. When a shot of steam is required, the state of the deviator 72 is changed such that a water-steam mixture is passed on to the auxiliary discharge unit 1*b*. The deviator 72 is connected to the steam generator 71 through a hose 73 or another suitable intermediate member.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the Figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the Figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

The present invention can be summarized as follows. A steam discharge unit 1, 2, 3 comprises a chamber 10 for accommodating a flow of a water-steam mixture and heating the water-steam mixture, an inlet 11 to the chamber 10, and an outlet 12 from the chamber 10. In order to avoid water droplets from exiting the chamber 10 through the outlet 12 along with a flow of steam, special measures are taken, which comprise a barrier 20 arranged inside the chamber 10, in a flow path of a water-steam mixture from the inlet 11 to the outlet 12, and a hydrophobic surface 30, preferably close to the outlet 12.

Preferably, the chamber 10 has a curved side wall 15, so that a circulating flow may be obtained inside the chamber 10, and the heat transfer to the water-steam mixture may be optimal. In this way, an effective water evaporation process is realized. Notwithstanding this, in case water droplets remain inside the chamber 10 and tend to move towards the outlet 12, an actual release of the water droplets from the chamber 10 cannot take place by virtue of the presence of the barrier 20 and the hydrophobic surface 30. When the discharge unit 1, 2, 3 is applied in a soleplate 61, 62 of a steam iron, for example, the well-known but undesirable spitting phenomenon does not occur, which is an important achievement of the present invention, while the soleplate design may be less complex and lower in mass than conventional designs.

Generally speaking, the present invention relates to a discharge unit 1, 2, 3 for use in a steaming device 70, comprising: a chamber 10 for accommodating a flow of a water-steam mixture and heating the water-steam mixture; an inlet 11 for supplying a water-steam mixture to the chamber 10; an outlet 12 for letting out steam from the chamber 10; a barrier 20 which is present inside the chamber 10, in a flow path of a water-steam mixture from the inlet 11 to the outlet 12, at a position for acting as an obstacle in a route from the inlet 11 to the outlet 12, which is to be circumvented by the flow; and a hydrophobic surface 30 which is present inside the chamber 10 as well, in the form of an exterior surface of a hydrophobic object such as a coating having a hydrophobic properties or a part made of a material having hydrophobic properties.

The invention claimed is:

1. A discharge unit for use in a steaming device, comprising:

a chamber for accommodating a flow of a water-steam mixture and heating the water-steam mixture, wherein the chamber comprises a curved wall, and wherein the inlet has a tangential orientation with respect to the curved wall of the chamber;

an inlet for supplying a water-steam mixture to the chamber;

an outlet for letting out steam from the chamber;

a barrier which is arranged inside the chamber, in a flow path of a water-steam mixture from the inlet to the outlet; and a hydrophobic surface which is located inside the chamber as a well.

2. The discharge unit according to claim 1, wherein the hydrophobic surface is located in the immediate surroundings of the outlet.

3. The discharge unit according to claim 1, wherein the barrier is arranged around the outlet, and wherein the hydrophobic surface surrounds the barrier.

4. The discharge unit according to claim 1, wherein the barrier is shaped like a tube.

5. The discharge unit according to claim 1, wherein the outlet is located at a wall of the chamber other than the curved wall.

6. The discharge unit according to claim 1, wherein the outlet has a central position with respect to the curved wall of the chamber.

7. The discharge unit according to claim 1, wherein the curved wall of the chamber is provided with a taper.

8. The discharge unit according to claim 1, further comprising a hydrophilic surface which is located inside the chamber for enhancing steam formation.

9. The discharge unit according to claim 1, wherein the chamber is shaped like a cylinder having two end walls and a curved side wall extending between the end walls wherein the barrier is shaped like a tube extending inwardly from one of the end walls of the cylinder.

10. The discharge unit according to claim 9, wherein the hydrophobic surface (30) is located at the tube-shaped barrier.

11. The discharge unit according to claim 9, wherein the tube-shaped harrier (20) surrounds the outlet.

12. The discharge unit according to claim 1, further comprising an additional barrier (40) which is located inside the chamber for directing the flow of the water-steam mixture.

13. The discharge unit according to claim 1, wherein a portion of an inner surface of the chamber surrounding the outlet is provided with a pattern of grooves and ribs.

14. A soleplate for use in a steam iron, which is provided with at least one discharge unit comprising:

a chamber for accommodating a flow of a water-steam mixture and heating the water-steam mixture, wherein the chamber comprises a curved wall, and wherein the inlet has a tangential orientation with respect to the curved wall of the chamber;

an inlet for supplying a water-steam mixture to the chamber;

an outlet for letting out steam from the chamber;

a barrier which is arranged inside the chamber, in a flow path of a water-steam mixture from the inlet to the outlet; and a hydrophobic surface which is located inside the chamber as a well.

15. A discharge unit for use in a steaming device, comprising:

a chamber for accommodating a flow of a water-steam mixture and heating the water-steam mixture wherein the chamber is shaped like a cylinder having two end walls and a curved side wall extending between the end walls, wherein the barrier is shaped like a tube extending inwardly from one of the end walls of the cylinder;

an inlet for supplying a water-steam mixture to the chamber;

an outlet for letting out steam from the chamber;

a barrier which is arranged inside the chamber, in a flow path of a water-steam mixture from the inlet to the outlet; and a hydrophobic surface which is located inside the chamber as a well.

16. The discharge unit according to claim 15, wherein the hydrophobic surface is located at the tube-shaped barrier.

17. The discharge unit according to claim 15, wherein the tube-shaped barrier surrounds the outlet.

18. The discharge according to claim 15, wherein a portion of an inner surface of the chamber-surrounding the outlet is provided with a pattern of grooves and ribs.

19. A soleplate for use in a steam iron, which is provided with at least one discharge unit comprising:

a chamber for accommodating a flow of a water-steam mixture and heating the water-steam mixture wherein the chamber is shaped like a cylinder having two end walls and a curved side wall extending between the end walls, wherein the barrier is shaped like a tube extending inwardly from one of the end walls of the cylinder;

an inlet for supplying a water-steam mixture to the chamber;

an outlet for letting out steam from the chamber;

a barrier which is arranged inside the chamber, in a flow path of a water-steam mixture from the inlet to the outlet; and a hydrophobic surface which is located inside the chamber as a well.

* * * * *